US012667190B2

(12) United States Patent
Kalitvencevs et al.

(10) Patent No.: US 12,667,190 B2
(45) Date of Patent: Jun. 30, 2026

(54) GALLEY SHELF

(71) Applicant: B/E Aerospace (UK) Limited, Leighton Buzzard (GB)

(72) Inventors: Germans Kalitvencevs, Milton Keynes (GB); Peter Ashley Griffiths, Kensworth (GB)

(73) Assignee: B/E Aerospace (UK) Limited, Leighton Buzzard (GB)

( * ) Notice: Subject to any disclaimer, the term of this patent is extended or adjusted under 35 U.S.C. 154(b) by 84 days.

(21) Appl. No.: 18/762,460

(22) Filed: Jul. 2, 2024

(65) Prior Publication Data

US 2025/0091718 A1 Mar. 20, 2025

(30) Foreign Application Priority Data

Sep. 19, 2023 (EP) ..... 23275135

(51) Int. Cl.
*A47B 96/02* (2006.01)

(52) U.S. Cl.
CPC ..... *A47B 96/02* (2013.01)

(58) Field of Classification Search
CPC ..... A47B 96/02; A47B 46/00; A47B 57/04; A47B 57/045; B64D 2011/0046; B64D 11/04
See application file for complete search history.

(56) References Cited

U.S. PATENT DOCUMENTS

| | | | | |
|---|---|---|---|---|
| 4,437,629 | A | 3/1984 | Roine | |
| 9,802,704 | B2 | 10/2017 | Young et al. | |
| 11,021,254 | B2 | 6/2021 | Swanson et al. | |
| 11,919,643 | B2 * | 3/2024 | Vaninetti | B64D 11/0023 |
| 2011/0101160 | A1 * | 5/2011 | Gomes | B64C 1/1423 244/118.5 |
| 2017/0043857 | A1 | 2/2017 | Seibt | |
| 2018/0281966 | A1 * | 10/2018 | Chuang | A47B 46/00 |
| 2019/0308728 | A1 * | 10/2019 | McKee | B64D 11/04 |
| 2019/0308729 | A1 * | 10/2019 | Riedel | B64D 11/04 |
| 2020/0354060 | A1 * | 11/2020 | Vaninetti | A47B 31/06 |
| 2021/0061470 | A1 * | 3/2021 | Burd | B64D 11/0007 |
| 2024/0051666 | A1 * | 2/2024 | Moe | B64D 11/064 |
| 2024/0391591 | A1 * | 11/2024 | Moe | B64D 11/04 |

FOREIGN PATENT DOCUMENTS

| | | |
|---|---|---|
| EP | 0668149 | 8/1995 |
| WO | 2006054064 | 5/2006 |
| WO | 2013148790 | 10/2013 |

OTHER PUBLICATIONS

European Patent Office; European Search Report dated Feb. 27, 2024 in Application No. 23275135.4.

* cited by examiner

*Primary Examiner* — Daniel J Rohrhoff

(74) *Attorney, Agent, or Firm* — ISNELL & WILMER L.L.P.

(57) ABSTRACT

An insertable galley unit for an aircraft galley, including a shelf, a hinge attached to the shelf, and a side wall. The shelf is rotatable about the hinge between a stowed position and a deployed position. The shelf includes a retractable latch, arranged to engage with the side wall to selectively hold the shelf in the stowed position and the deployed position.

16 Claims, 8 Drawing Sheets

GALLEY SHELF

CROSS-REFERENCE TO RELATED APPLICATIONS

This application claims priority to and the benefit of EP Patent Application No. 23275135.4, filed Sep. 19, 2023 and titled "GALLEY SHELF," which is incorporated by reference herein in its entirety for all purposes.

FIELD

This disclosure relates to a stowable shelf for use in the galley of an aircraft.

BACKGROUND

A galley of an aircraft is used to prepare food for passengers over the duration of a flight, and therefore must be suitable for storage of foodstuffs, appliances, and more, to aid the preparation and distribution of food and drink. The galley has a very limited amount of storage space, which must be optimized in order to fit in as much as possible for the passengers' comfort. Additionally, the compartments of the galley may have many different purposes throughout the flight, for example a compartment which was used to store food at the start of the flight may be used to store waste after the food is served.

However, a galley is typically a fixed structure, which cannot be easily adapted for different purposes during flight by the members of the flight crew, and typically cannot be re-arranged without the use of tools. This may present a problem where a particular compartment has different uses over the duration of a flight.

The present disclosure aims to provide a solution to non-adaptable galley stowage.

SUMMARY

According to this disclosure there is provided an insertable galley unit for an aircraft galley, wherein the insertable galley unit comprises:

a shelf;

a hinge attached to the shelf; and a side wall;

wherein the shelf is rotatable about the hinge between a stowed position and a deployed position;

wherein the shelf comprises a retractable latch; and wherein the retractable latch is arranged to engage with the side wall to selectively hold the shelf in the stowed position and the deployed position.

Therefore, the skilled person will appreciate that, in at least some examples, the present disclosure provides a shelf which may be adjusted between a stowed and deployed position without the use of tools.

In some examples, the shelf is to be installed in the galley of an aircraft, and be integrated into a galley compartment. The galley unit may be installed into the aircraft during the manufacturing of the aircraft, with a layout that is not able to be changed during the course of operation of the aircraft. A galley unit is typically arranged to receive galley boxes and other equipment to be used during the course of flight.

Including a shelf in the galley unit may allow aircraft crew members to change the layout of the galley compartments very quickly, to adapt the stowage space. The galley of an aircraft is typically a fixed structure, which cannot be changed during flight and requires tools to change when on the ground, meaning that it is not easily reconfigured. Therefore, this shelf may provide a way to sub-divide a galley during flight, which may optimize the on-board storage.

In some examples, the insertable galley unit comprises a side wall and a back wall, wherein the back wall is substantially perpendicular to the side wall. The hinge may be attached to the back wall in addition to being attached to the shelf, e.g. such that the shelf is rotatable relative to the back wall. In some examples, the hinge may be attached to the side wall of the insertable galley unit.

In some examples, the hinge is a piano hinge. The piano hinge may allow for the shelf to take up a minimum amount of space in the galley when it is either deployed or stowed, to allow for maximum stowage space within the galley.

In some examples, the piano hinge extends along the full length of the shelf. This may allow the shelf to support heavy objects along its length without bending or twisting, and may increase the stability of the shelf.

The shelf is rotatable from a stowed position (e.g. upright), to a deployed position via a hinge. In an example, when in the stowed position, the shelf is parallel to the back wall of the galley, and therefore takes up a minimal amount of space within the galley. In the deployed position, the shelf is perpendicular to the back wall. In some examples the shelf is substantially horizontal, allowing for the galley compartment to be easily divided during flight.

In some examples, the retractable latch is arranged to project from the shelf so to engage with the side wall. In some examples, the retractable latch is arranged to at least partially retract into the shelf so to release the retractable latch from being engaged with the side wall, e.g. the retractable latch is stored within the shelf when in a retracted position, and projects out from the shelf when in an unretracted position, e.g. when engaged with the side wall. The latch may be slid in and out of the shelf, and may be moved by a switch on the surface of the shelf, for easy selection of the shelf position.

In some examples, the retractable latch is parallel to the hinge when engaged with the side wall. Thus, in some examples, the latch projects out of the shelf in a direction parallel to the hinge. In this example the latch is perpendicular to the side wall, which may provide optimal engagement between the latch and the wall to prevent undesired movement of the shelf.

In some examples, the retractable latch is part of a retractable latch mechanism, wherein the retractable latch mechanism is embedded within the shelf. This may minimize the space taken up by the shelf within the galley unit.

In some examples, the switch is on the side of the shelf parallel to and spaced from the hinge. This may allow for the shelf to take up minimal space in the galley whether it is stowed or deployed, e.g. the shelf is flush to the back wall, whilst still allowing easy access to the switch such that the shelf is easily moved.

In some examples, there are two retractable latches, positioned at different ends of the shelf, e.g. the two retractable latches may be positioned at opposite ends of the shelf when the shelf is installed between two side walls within a galley compartment where the first and second side walls are opposite to one another. Each retractable latch is arranged to engage with the respective side wall, to selectively hold the shelf in the stowed position and the deployed position. This may allow for increased stability of the shelf, as, in examples, the shelf is anchored on three sides to the galley, by a hinge to the back wall and by a retractable latch to each of the side walls. This may prevent the shelf from moving around excessively during flight, or falling from the stowed to the deployed positions unintentionally.

In some examples, the retractable latch is bistable, e.g. such that the retractable latch is stable in its engaged (e.g. projected) position and in its disengaged (e.g. retracted) position. This may allow for latch to be retracted for moving the shelf between the stowed and deployed positions (or vice versa), and then reengaged manually once the shelf has been moved into the desired position. In an example where there are two latches, one at each end of the shelf, the user may disengage each latch one at a time, and then move the shelf. This may be useful in an aircraft galley where the shelf is particularly long, or the aircraft is shaking, such that it may be impractical to have to disengage both latches together.

In some examples, the retractable latch is spring-loaded, e.g. such that the retractable latch is biased towards the engaged (e.g. projected) position or the disengaged (e.g. retracted) position. This may allow for the latch to naturally be in an engaged position, e.g. the user may have to hold the switch in order to retract the latch into the shelf and change the position of the shelf.

In an example where there are two latches, one at each end of the shelf, the user may hold both switches in order to disengage both latches and move the shelf. This may made it harder to accidentally disengage the latches and move the shelf, which may be useful during flight where due to moving items in the galley, it may be easy to accidentally move the switch and hence move the shelf, which may be dangerous and damage goods in the galley.

In some examples, the side wall comprises a first aperture arranged to receive the retractable latch when the shelf is in the stowed position, and a second aperture arranged to receive the retractable latch when the shelf is in the deployed position. This allows the retractable latch to be inserted into the side wall in order to hold the shelf in both the stowed and deployed positions. This may allow the shelf to be securely fastened to the wall during flight.

In some examples, the inner perimeter of (e.g. each of) the apertures is larger than the outer perimeter of the retractable latch. This may allow for the aperture to receive the latch easily even at the extremes of the manufacturing tolerances of the apertures and the latch. This may also prevent degradation of the latch from rubbing against the apertures, and additionally make it easier for the shelf to be adjusted between positions.

In some examples, the inner perimeter of (e.g. each of) the apertures is lined with a flexible material, e.g. silicone. This flexible material may provide a soft padding to receive the retractable latch, may be used on top of the stopper to press the latch's pin to the side to prevent rattling of the shelf during flight. This may be useful where the latch is slightly smaller than the aperture, and hence may allow for wider manufacturing tolerances for both the latch and galley.

In some examples, the side wall comprises a bracket, wherein the shelf is arranged to be in contact with (e.g. rest upon) the bracket when in the deployed position. The shelf may be arranged to sit on the bracket, e.g. the underside of the shelf is arranged to be in contact with the upper surface of the bracket. This may hold the shelf in a substantially horizontal position when deployed, and may help to prevent things sliding off the shelf during flight.

The surface of the bracket (that is arranged to be in contact with the shelf, when the shelf is in the deployed position) may be coated with a flexible material, e.g. silicone. This may prevent rattling of the shelf during flight when in the deployed position.

In some examples, a shock absorber may be fixed to the back wall of the galley (e.g. the (e.g. back wall of the) galley unit may comprise a shock absorber), such that when the shelf is in the stowed position, the shock absorber may be situated between the shelf and the back wall of the galley, e.g. the shelf may be arranged to contact the shock absorber when the shelf is in the stowed position. This may prevent rattling of the shelf during flight when in the stowed position. The shock absorber may be made of a flexible material, e.g. silicone.

In some examples, the bracket is vertically adjustable. This may allow the bracket to be moved such that it is in correct alignment with the shelf and to minimize rattling, and optimize the position of the shelf, e.g. to hold the shelf in a substantially horizontal position.

In some examples, the shelf is made of a material which comprises a honeycomb structure. This may allow the shelf to be made of a lightweight material such as cardboard, whilst still having the structural integrity to carry heavy loads within the cabin.

BRIEF DESCRIPTION OF THE DRAWINGS

One or more non-limiting examples will now be described, by way of example only, and with reference to the accompanying figures in which.

DETAILED DESCRIPTION

The examples described herein may be used for a stowable shelf within the galley of an aircraft. Other applications where a stowable shelf would be required are, however, also envisaged (e.g. on a train or other passenger vehicle) and the examples are not limited to this.

Figure 1A:
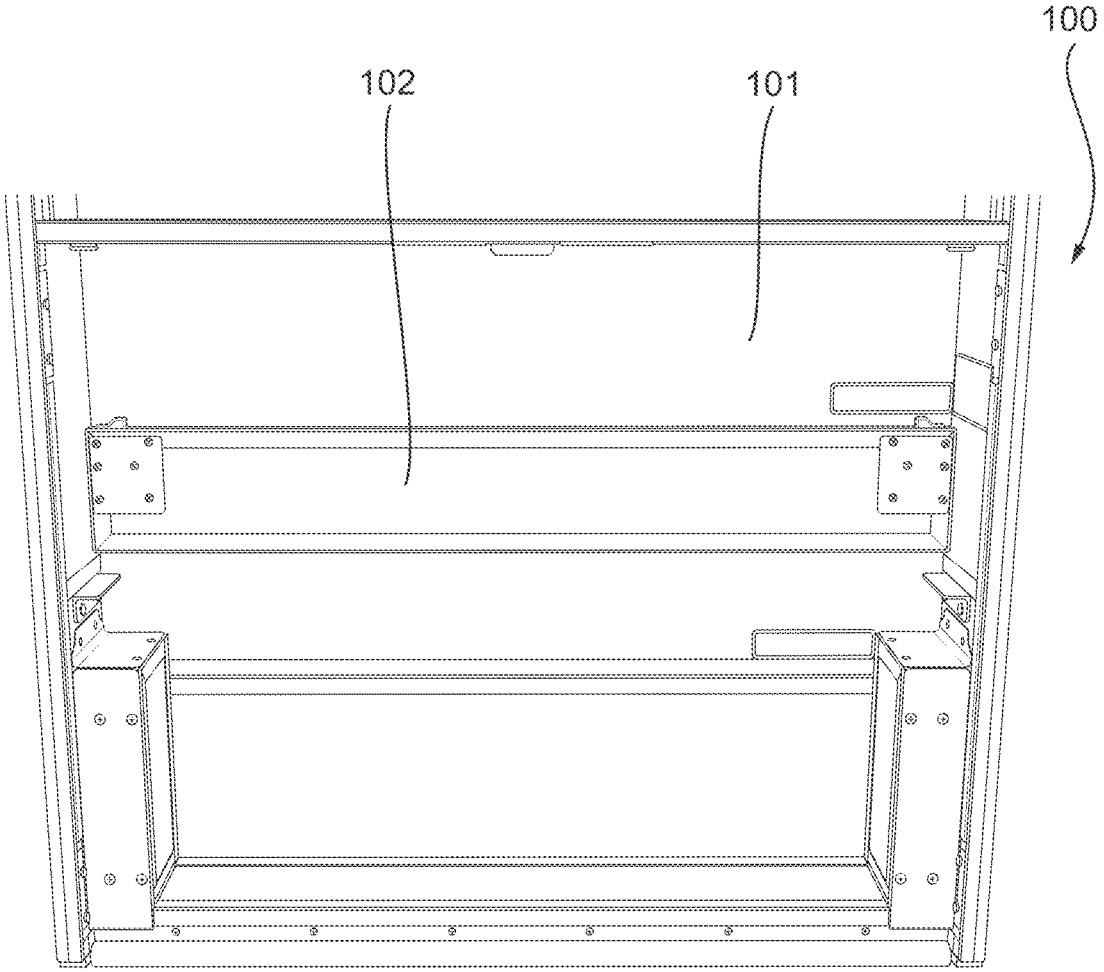
FIG. 1*a* shows a shelf in a galley, stowed in an upright position.
Figure 1B:
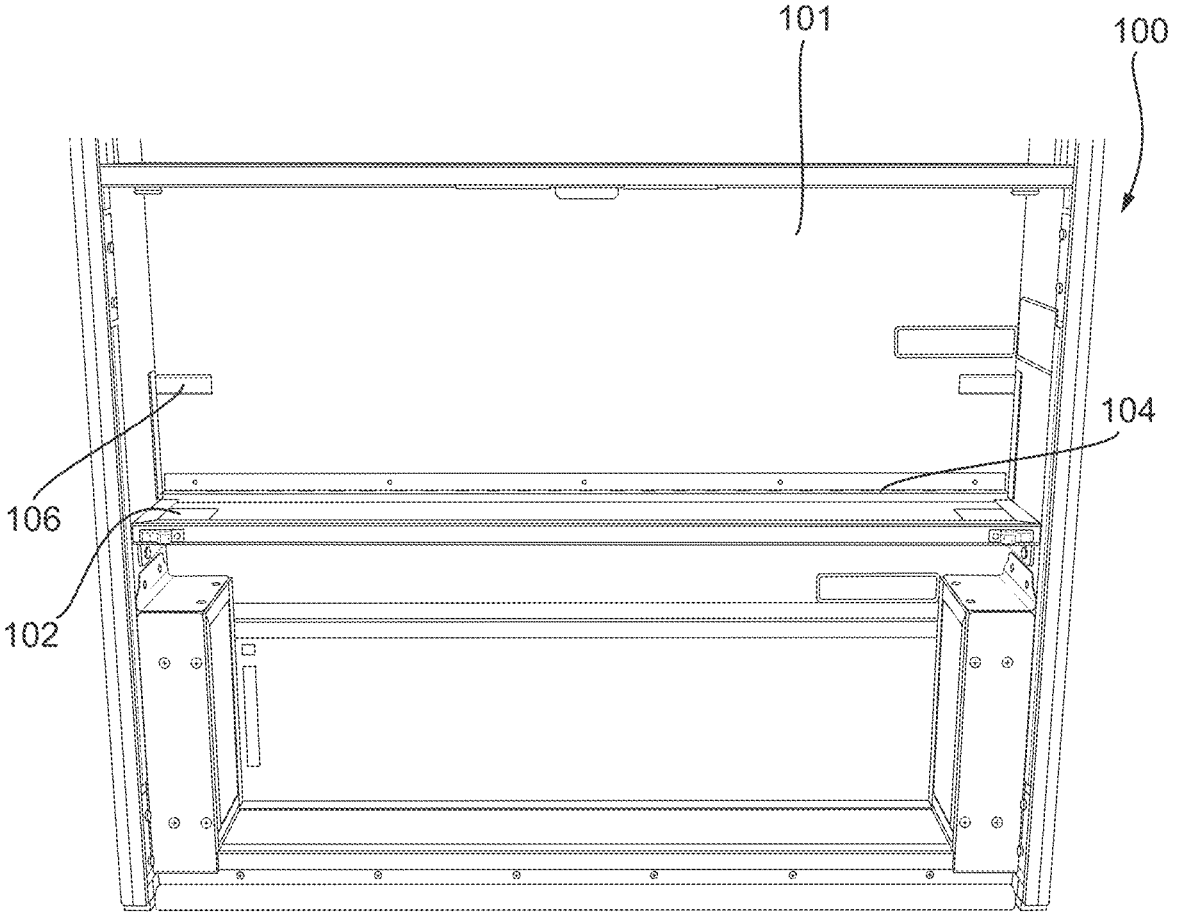
FIG. 1*b* shows the shelf of FIG. 1*a*, deployed in a lowered position.

FIG. 1*a* shows a shelf 102 within an aircraft galley 100, with the shelf in the stowed position. FIG. 1*b* shows a schematic view of the shelf 102 within the aircraft galley 100, with the shelf in the deployed position.

The shelf 102 is connected to the back wall 101 via a piano hinge 104. When in the stowed position shown in FIG. 1*a*, the shelf 102 is substantially parallel to the back wall 101. The shelf 102 is rotatable about the piano hinge 104, to the deployed position where the shelf 102 is substantially perpendicular to the back wall 101 shown in FIG. 1*b*.

A shock absorber 106 is fixed to the back wall 101, such that when the shelf 101 is in the stowed position, the shock absorber 106 is situated between the shelf 102 and the back wall 101. This may prevent the shelf from rattling around and damaging the back wall 101 during the flight of the aircraft.

Figure 2:
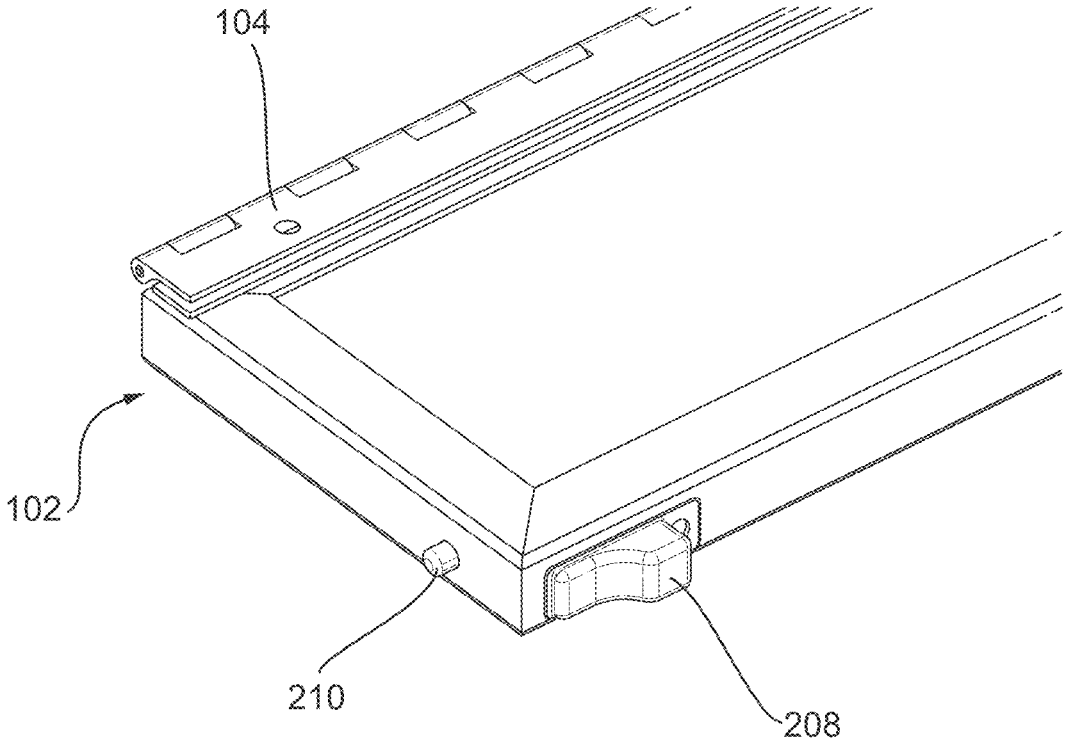
FIG. 2 shows an enlarged view of the shelf of FIG. 1*b;*

FIG. 2 shows an enlarged view of one end of the shelf 102. The piano hinge 104 extends along the full length of the shelf 102. The shelf 102 additionally comprises a retractable latch 210, which can be moved in and out of the shelf 102 using the switch 208.

The switch 208 is a bistable switch, allowing for the latch 210 to be held stably in either an extended position shown in FIG. 2, or in a retracted position (not shown). When the shelf 102 is in the stowed or deployed position, the retractable latch 210 may be extended in order to hold the shelf 102 in the desired (stowed or deployed) position. When the shelf is being moved between the stowed and deployed positions, the retractable latch 210 may be retracted in order to allow for movement of the shelf.

By using the retractable switch 208 to adjust the position of the shelf 102 between the stowed and deployed positions, and to hold the shelf 102 in each of the stowed and deployed positions, this allows the cabin crew to easily rearrange the galley without the need for any tools.

Figure 3A:
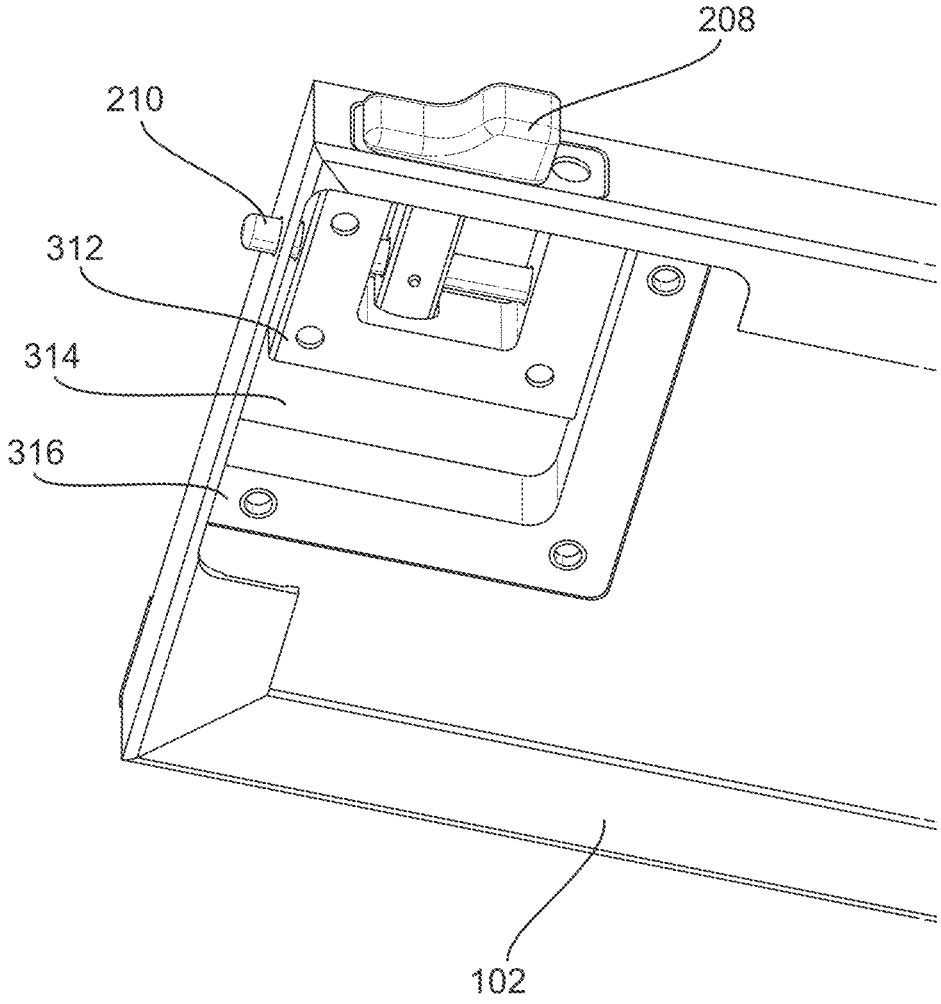
FIG. 3*a* shows an enlarged view of the locking mechanism of the shelf of FIG. 1*b;*

FIG. 3*a* shows an enlarged cut-away view of one end of the shelf 102. The retractable latch 210 is held within a frame 312, with the latch 210 attached to the switch 208 for movement between the extended and retracted positions.

Figure 3B:
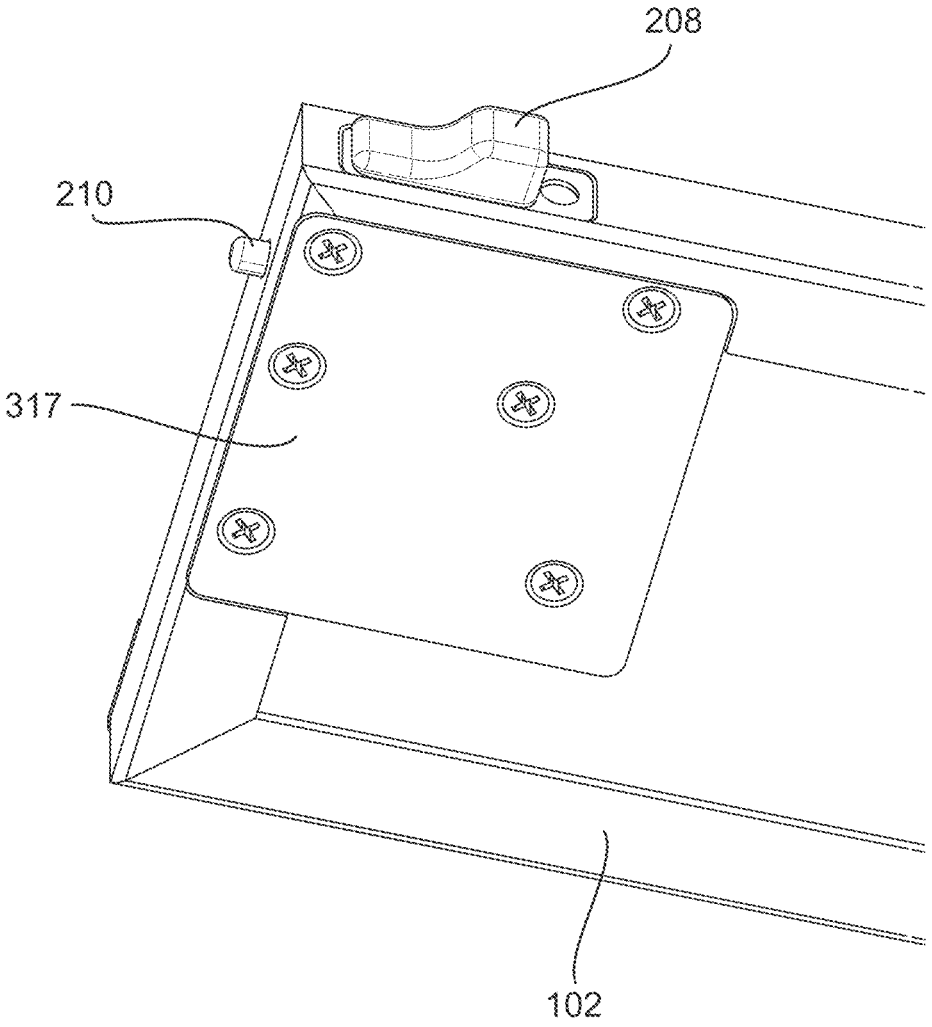
FIG. 3*b* shows the locking mechanism of the shelf of FIG. 3*a* with an external plate fitted.

FIG. 3*b* shows the enlarged view of one end of the shelf 102 as shown in FIG. 3*a*, with an external plate 317 screwed onto the shelf 102 to cover the frame 312 of the retractable latch 210.

The frame 312 is located within a hollow region 314 of the shelf 102. The shelf may be made of a cardboard with a honeycomb structure, which may reduce the weight of the galley. The honeycomb structure may become fragile with a hollow region 314 present, so the hollow region is reinforced with a flange 316, in order to help retain the structural integrity of the shelf 302.

Figure 4:
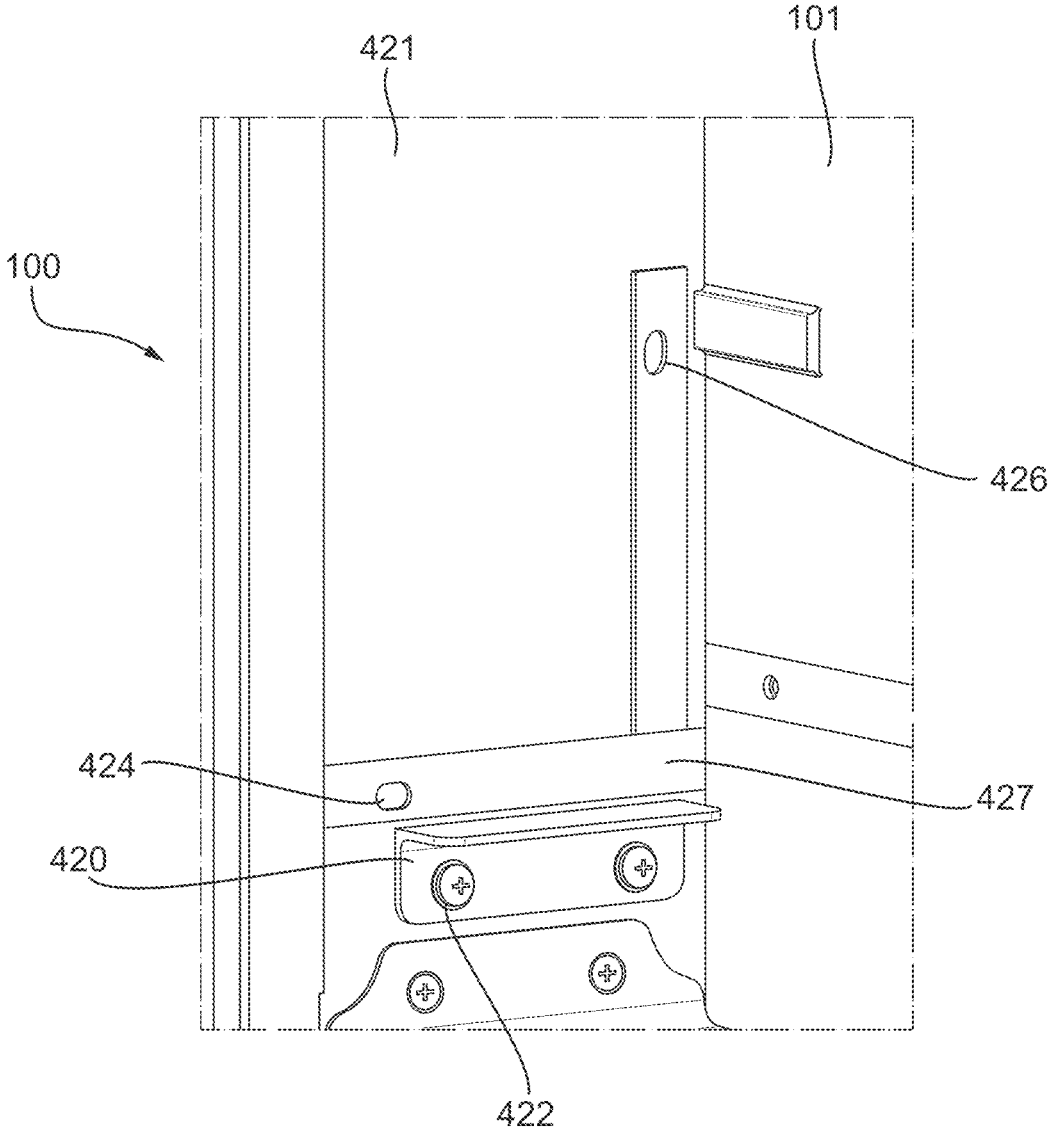
FIG. 4 shows the galley with the shelf removed.

FIG. 4 shows an enlarged view of part of an aircraft galley 100, with the shelf removed, for clarity. The galley 100 comprises a compartment formed from the back wall 101, and side walls 421, perpendicular to the back wall 101. The side wall 421 comprises a first aperture 424 and a second aperture 426, which are arranged to receive the retractable latch of the shelf, when the shelf is in the deployed and stowed positions respectively.

The back wall 101 and side wall 421 may also have a reinforcing strip 427, integrated with the walls 101, 421 in order to reinforce the galley compartments in the positions where the shelf is fixed, in the deployed and stowed positions. This may prevent degradation of the galley compartments as the shelf is moved between the deployed and stowed positions.

A bracket 420 is attached via a pair of screws 422 to the side wall 421, below the first aperture 424. When the shelf is in the deployed position, it can rest on the bracket 420, which may make it easier to extend the latch of the switch into the first aperture 424.

Figure 5:
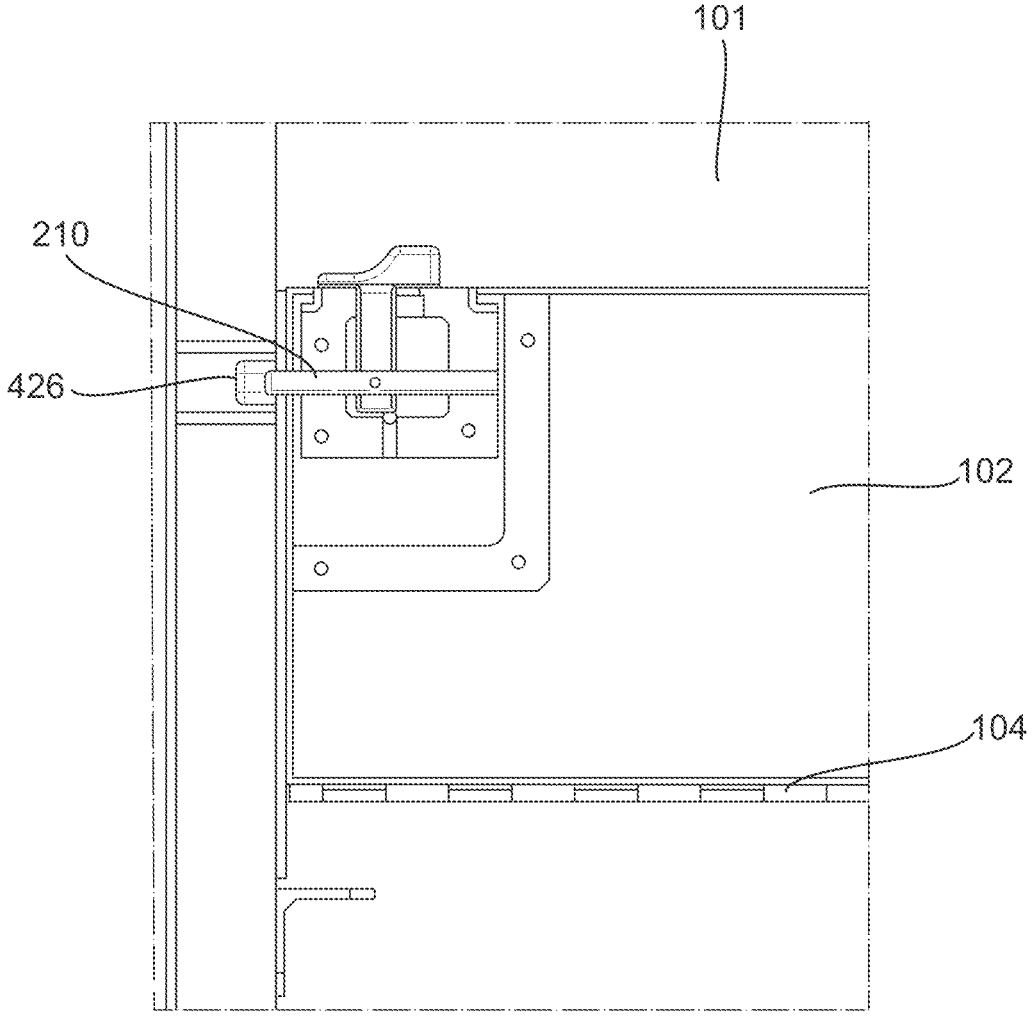
FIG. 5 shows a cross-sectional view of the shelf stowed in an upright position shown in FIG. 1*a*.

FIG. 5 shows an enlarged cross-sectional view of the shelf 102 when in the stowed position. The retractable latch 210 extends into the second aperture 426, in order to hold the shelf 102 in place when stowed. The latch 210 is slightly smaller than the size of the first and second apertures 424, 426, which may account for the manufacturing tolerances of the latch 210, the first and second aperture 424, 426, and the position of the piano hinge 104 on the back wall 101, to ensure that the latch 210 will fit into the first and second aperture 424, 426 even if there is a small amount of misalignment between the first and second apertures 424, 426 and the latch 210.

The inside of the second aperture 426 is coated with a flexible material, such as silicone. This may ensure that the shelf does not rattle or cause excessive damage during flight, caused by the latch 210 being smaller than the second aperture 426, especially in the case of misalignment between the latch 210 and the second aperture 426.

Figure 6:
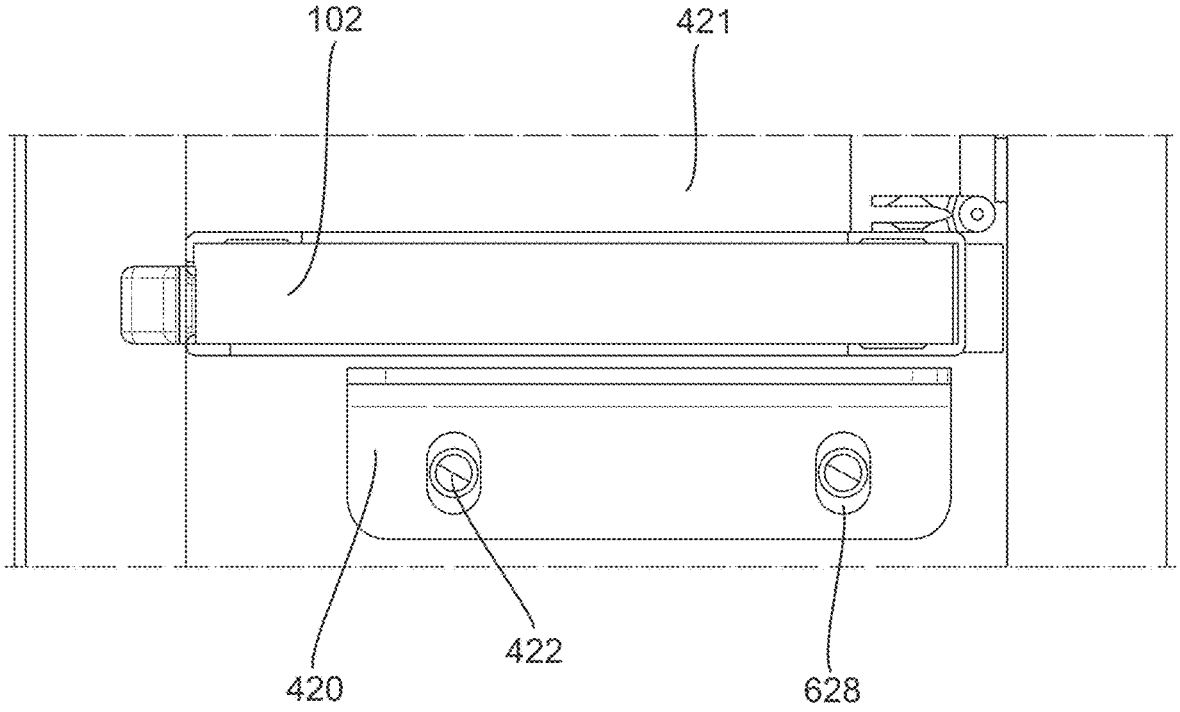
FIG. 6 shows a cross-sectional view of the shelf when deployed in a lowered position.

FIG. 6 shows a cross-sectional view of the side wall 421, with the shelf 102 in the deployed position, resting against the bracket 420. The bracket 420 is fixed to the side wall 421 by screws 422, threaded through holes 628 in the bracket. The holes 428 are slightly longer than the diameter of the screw thread of the screws 422. This may allow for the height of the bracket 420 to be easily adjusted, to enable the shelf to still be securely positioned despite differences in manufacturing tolerances between components of the galley.

What is claimed is:

1. An insertable galley unit for an aircraft galley, wherein the insertable galley unit comprises:
- a shelf;
- a hinge attached to the shelf;
- a side wall;
  - wherein the shelf is rotatable about the hinge between a stowed position and a deployed position;
  - wherein the shelf comprises a retractable latch; and
  - wherein the retractable latch is arranged to engage with the side wall to selectively hold the shelf in the stowed position and the deployed position; and
- a bracket, wherein the shelf is arranged to be in contact with the bracket when in the deployed position.

2. The insertable galley unit as claimed in claim 1, wherein the retractable latch is arranged to project from the shelf so to engage with the side wall.

3. The insertable galley unit as claimed in claim 2,
- wherein the retractable latch is arranged to project from an end of the shelf so to engage with the side wall; and
- wherein the retractable latch is arranged to at least partially retract into the shelf so to release the retractable latch from being engaged with the side wall.

4. The insertable galley unit as claimed in claim 1, further comprising a retractable latch mechanism;
- wherein the retractable latch mechanism is embedded within the shelf; and
- wherein the retractable latch mechanism comprises the retractable latch.

5. The insertable galley unit as claimed in claim 1, wherein the retractable latch is a bistable latch.

6. The insertable galley unit as claimed in claim 1, wherein the retractable latch is spring-loaded.

7. The insertable galley unit as claimed in claim 1, wherein the side wall comprises:
- a first aperture arranged to receive the retractable latch when the shelf is in the stowed position; and
- a second aperture arranged to receive the retractable latch when the shelf is in the deployed position.

8. The insertable galley unit as claimed in claim 7, wherein an inner perimeter of the first aperture and the second aperture is larger than an outer perimeter of the retractable latch.

9. The insertable galley unit as claimed in claim 7, wherein an inner perimeter of the first aperture and the second aperture is lined with a flexible material.

10. The insertable galley unit as claimed in claim 1, further comprising a back wall and a shock absorber;
- wherein the shelf is parallel to the back wall when in the stowed position;
- wherein the shock absorber is attached to the back wall; and
- wherein the shock absorber is arranged to be between the shelf and the back wall when the shelf is in the stowed position.

11. The insertable galley unit as claimed in claim 1, wherein a surface of the bracket arranged to be in contact with the shelf is coated with a flexible material.

12. The insertable galley unit as claimed in claim 11, wherein the bracket is vertically adjustable.

13. The insertable galley unit as claimed in claim 1, wherein the retractable latch comprises a first retractable latch, and the side wall comprises a first side wall;

wherein the insertable galley unit further comprises:

a second retractable latch; and a second side wall;

wherein the first retractable latch is at a first end of the shelf;

wherein the second retractable latch is at a second end of the shelf; and wherein the second retractable latch is arranged to engage with the second side wall to selectively hold the shelf in the stowed position and the deployed position.

14. The insertable galley unit as claimed in claim 1, wherein the shelf comprises a honeycomb structure.

15. The insertable galley unit as claimed in claim 1, wherein the shelf is substantially horizontal when in the deployed position.

16. An insertable galley unit for an aircraft galley, wherein the insertable galley unit comprises:

a shelf;

a hinge attached to the shelf;

a side wall;

wherein the shelf is rotatable about the hinge between a stowed position and a deployed position;

wherein the shelf comprises a retractable latch; and wherein the retractable latch is arranged to engage with the side wall to selectively hold the shelf in the stowed position and the deployed position; and a back wall and a shock absorber;

wherein the shelf is parallel to the back wall when in the stowed position;

wherein the shock absorber is attached to the back wall; and wherein the shock absorber is arranged to be between the shelf and the back wall when the shelf is in the stowed position.

* * * * *